US006334699B1

(12) United States Patent
Gladnick

(10) Patent No.: US 6,334,699 B1
(45) Date of Patent: Jan. 1, 2002

(54) SYSTEMS AND METHODS FOR DIFFUSE ILLUMINATION

(75) Inventor: Paul G. Gladnick, Seattle, WA (US)

(73) Assignee: Mitutoyo Corporation, Kawasaki (JP)

( * ) Notice: Subject to any disclaimer, the term of this patent is extended or adjusted under 35 U.S.C. 154(b) by 0 days.

(21) Appl. No.: 09/288,221

(22) Filed: Apr. 8, 1999

(51) Int. Cl.[7] ..... F21V 21/26

(52) U.S. Cl. ..... 362/268; 362/269; 362/280; 362/305; 362/310; 356/354

(58) Field of Search ..... 362/269, 280, 362/281, 299, 305, 310; 356/354; 430/311; 359/618

(56) References Cited

U.S. PATENT DOCUMENTS

| | | | | | |
|---|---|---|---|---|---|
| 3,750,189 | A | * | 7/1973 | Fleischer | 340/173 |
| 4,567,551 | A | | 1/1986 | Choate | |
| 4,706,168 | A | | 11/1987 | Weisner | |
| 4,729,070 | A | | 3/1988 | Chiu | |
| 4,893,223 | A | | 1/1990 | Arnold | |
| 5,038,258 | A | | 8/1991 | Koch et al. | |
| 5,307,207 | A | | 4/1994 | Ichihara | |
| 5,398,041 | A | * | 3/1995 | Hyatt | 345/88 |
| 5,523,193 | A | * | 6/1996 | Nelson | 430/311 |
| 5,625,448 | A | * | 4/1997 | Ranalli et al. | 356/71 |
| 5,690,417 | A | | 11/1997 | Polidor et al. | |
| 5,753,903 | A | | 5/1998 | Mahaney | |
| 6,043,885 | A | * | 3/2000 | Mazuet et al. | 356/354 |

* cited by examiner

*Primary Examiner*—Sandra O'Shea
*Assistant Examiner*—Bertrand Zeade
(74) *Attorney, Agent, or Firm*—Oliff & Berridge, PLC

(57) ABSTRACT

A light pattern controller provides a pattern of light to a collimator. The light pattern controller includes a beam deflector that sweeps a circular pattern with a radius that is directly proportional to the rotational speed of the beam deflector. Alternatively, the light pattern controller includes a two-dimensional scanning galvanometer that sweeps out the circular pattern or a liquid crystal shutter. The pattern of light is collimated and reflected such that it is substantially parallel to the optical axis of an imaging system. A focusing element redirects the collimated light pattern onto a sample part at an angle of incidence which is a function of the radius of the light column.

52 Claims, 7 Drawing Sheets

SYSTEMS AND METHODS FOR DIFFUSE ILLUMINATION

BACKGROUND OF THE INVENTION

1. Field of Invention

This invention relates to systems and methods to generate diffuse illumination. In particular, this invention is directed to a diffuse light source for a machine vision system.

2. Description of Related Art

Uniform, diffuse illumination of a sample part is often necessary in commercial vision systems to accentuate an edge of the sample part within a designated field of view. Since most sample parts are not transparent, diffuse illumination of the sample part is also necessary so that light which is reflected from the sample part can be collected by an imaging system. Furthermore, an adjustable diffuse illumination source accommodates sample parts having a wide variety of shapes.

Typically, the intensity of light emitted by a light source is adjustable when the magnification of the imaging system is also adjustable. The adjustable illumination provides the ability to illuminate sample parts having different characteristics, such as, for example, shape, composition, and surface finish.

Also, conventional light sources project light onto the sample part at an angle from a plane which is normal to the imaging plane. This angle is referred to as the angle of incidence. Light projected at an angle of incidence which is between 0 and 90 degrees may improve the surface contrast of the image and also more clearly illuminate textured surfaces. Typically, such light sources have a prescribed range for the angle of incidence. Conventionally, the angle of incidence varies between 10° and 70° relative to the plane which is normal to the optical axis of the imaging system. Such a range is relatively broad and, therefore, provides adequate contrast in an image of a sample part.

Furthermore, conventional vision systems can also adjust the circumferential position of the source of diffuse lighting about an optical axis. Typically, the position of the diffuse lighting source is adjustable in, for example, addressable sectors or quadrants. As such, any combination of sectors and quadrants of such a circular light pattern can be illuminated. Additionally, the intensity level of the light source can be coordinated with the circumferential position of the light source to optimize the illumination of a sample part edge.

For example, some conventional vision systems include an annular light source that emits rectangular or toroidal patterns. The light source is an annulus which is divided into four quadrants. Also, other conventional vision systems include a ring light having an annulus which is subdivided into eight sectors. Additionally, some conventional vision systems have hemispherically-shaped light sources to direct light from a multitude of positions relative to an optical axis. The center of the hemisphere serves as a focal point for the light sources. Furthermore, any combination of sectors and quadrants can simultaneously be illuminated with varying illumination levels.

SUMMARY OF THE INVENTION

Recently, manufacturers of conventional vision systems have started offering a solid-state replacement for the traditional tungsten filament lamp, e.g., a halogen lamp, that has been used in conventional diffuse light sources. These manufacturers now offer light emitting diodes (LEDs) that offer higher reliability, a longer service life, greater brightness, lower cost, good modulation capabilities and a wide variety of frequency ranges.

Some manufacturers of such conventional vision systems provide opto-electro-mechanical designs that partially achieve the characteristics of the conventional diffuse light sources discussed above. However, these opto-electro-mechanical devices are complicated, costly, lack versatility, and do not enhance a video inspection process. For example, these light sources require overly intricate mechanical motion which results in a lower vision system throughput and an increase in cost. Other conventional solid-state light sources require a large number of discrete light sources in a two-dimensional array and an elaborate electronic cross-bar to energize them. Furthermore, other conventional solid-state light sources must accommodate at least fifty discrete light sources in a three-dimensional array housed in a large carriage.

Accordingly, conventional diffuse light sources are incapable of providing a full-featured, reliable, inexpensive system and method to diffusely illuminate a sample part. Moreover, conventional diff-use light sources only marginally provide the capability to alter the intensity, angle of incidence and circumferential position. Such conventional diffuse light sources do not optimally illuminate sample parts for dimensional measurements when varying construction (e.g., shape), material (e.g., absorptivity, scattering, etc.), and surface properties (e.g., color or texture) are involved.

The systems and methods of this invention achieves the diffuse lighting effects that are currently offered on the market. In addition, this invention offers all these features using a single solid-state source or small number of solid-state sources, such as LEDs or laser diodes.

Further, the systems and methods of this invention provide an economically viable way to obtain color images by assembling RGB images from a monochrome camera. A monochrome camera provides high spatial resolution that is necessary for dimensional measurements without using expensive CCD color camera technology.

This invention provides systems and methods that create conventional as well as more versatile diffuse illumination using a simpler, more robust device. In addition, the systems and methods of this invention allow the selection of illumination color. Therefore, the illumination color may be controlled based on the sample part properties (e.g., pigmentation) in order to improve image contrast. Also, illumination color selection is used to produce a high resolution color image using a monochrome CCD detector. Thus, the systems and methods of this invention preserve the high resolution necessary for dimensional metrology measurements without the unnecessary expense of CCD color camera technology.

Still further, an exemplary embodiment of the systems and methods of this invention incorporate optical source monitoring as described in U.S. patent application No. 09/220,705 filed Dec. 24, 1998 which is incorporated herein in its entirety. The optical source monitoring measures the real-time optical power output from the solid-state devices. This is possible on continuous or pulse operated systems. The measurements are taken so that power output variations may be corrected. Power output variations are due primarily to aging, drive current fluctuations and temperature drifts. The intensity measurements permit a level of calibration and instrument standardization which can yield reproducible illumination among an instrument model line.

One exemplary embodiment of the systems and methods of this invention includes a beam deflector that is mounted on a motor shaft. The beam deflector has a mirror. The beam deflector tilts in proportion to the centrifugal force exerted on the beam deflector when the motor shaft rotates. A light beam incident upon the mirror is deflected by an angle which is defined by the tilt of the beam deflector.

Additionally, because the beam deflector is rotating the deflected light beam sweeps out a cone. The deflected light beam cone is incident upon a focusing element and sweeps out a circular pattern on the surface of the focusing element. The radius of the circular pattern is dependent upon both the distance of the focusing element from the beam deflector and the angle at which the light beam is deflected. The greater the angle of deflection and the farther the focusing element is from the beam deflector, the larger the circular pattern becomes. Therefore, since the rotational speed of the motor shaft is directly proportional to the deflection angle and since the size of the circular pattern is directly proportional to the deflection angle, the size of the circular pattern is directly proportional to the rotational speed of the motor shaft.

Also, the speed at which the light beam traverses the circular pattern is directly proportional to the rotational speed of the motor shaft. Therefore, the rotational speed of the motor shaft controls both the size of the circular pattern and the speed with which the light beam traverses the light pattern. Thus, the motor and beam deflector control the light pattern.

The light beam is collimated by the focusing element to sweep out a column. This column of light is reflected by a mirror to be substantially parallel to and to encompass an optical axis of an imaging device of a vision system. The imaging device, which may include a CCD, employs optical lenses to produce an image of a sample part positioned in a field of view and located at an object plane. The collimated pattern is focused onto the same field of view using another focusing element. Reflected and scattered light from the field of view is imaged onto the CCD using optical lenses.

These and other objects of the invention will be described in or be apparent from the following description of the preferred embodiments.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1:
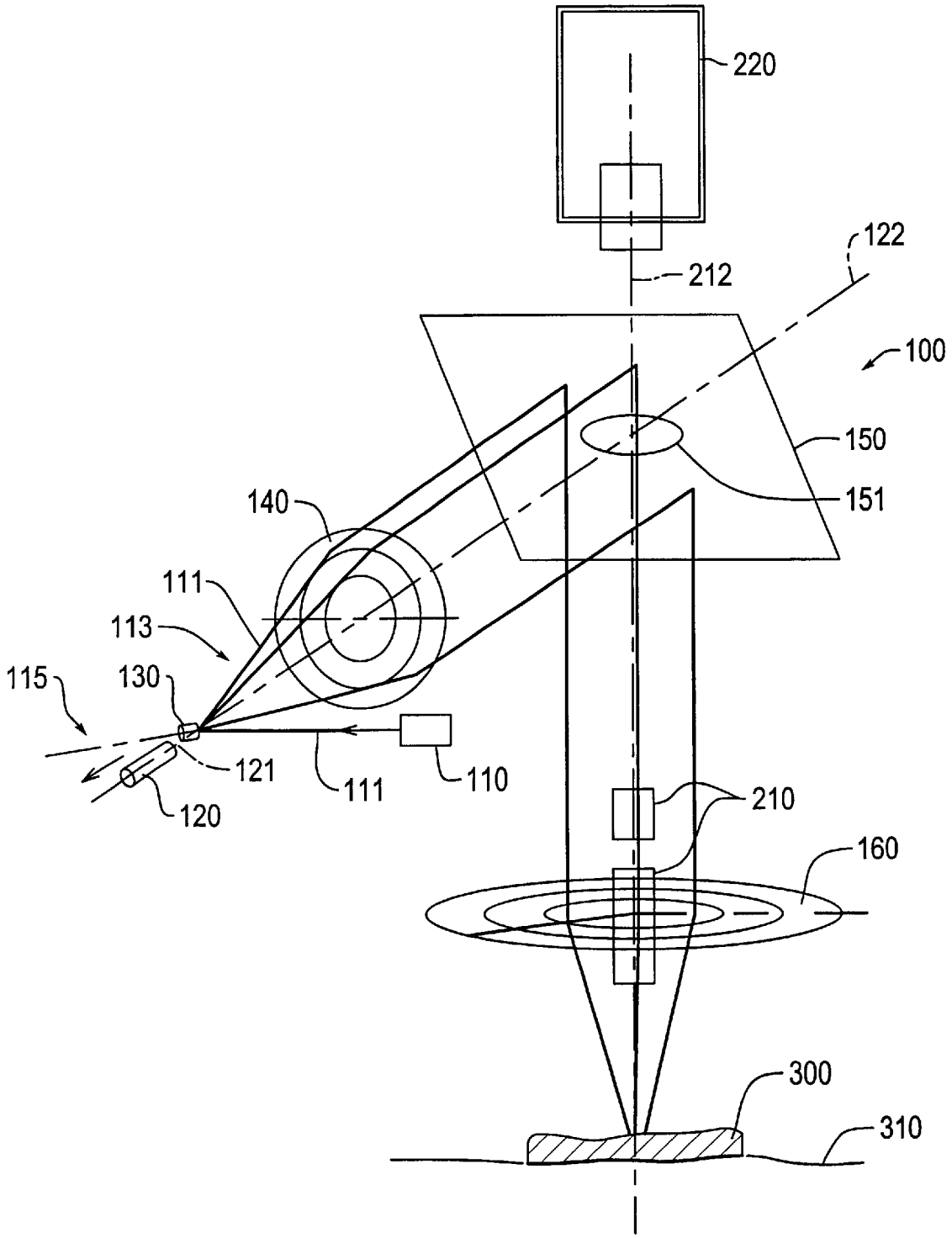
FIG. 1 is a schematic diagram of an exemplary embodiment of a diffuse lighting system according to this invention.

FIG. 1 is a schematic diagram of an exemplary diffuse illumination system 100 25 of this invention. The system 100 includes a light source 110 emitting a light beam 111, a light pattern controller 115, a collimating element 140, a mirror 150 and a focusing element 160. The light pattern controller 115 includes a motor 120 and a beam deflector 130. FIG. 1 also shows an imaging system 200 which includes a camera 220 and an optical system 210 which produces an image of a sample part 300. The system 100 illuminates the sample part 300 on an inspection plane 310 so that the imaging system may obtain an image of the sample part 300.

The light source 110 has one or more solid-state light emitting devices that are stable and have a long service life. The solid-state light emitting devices may include LEDs or laser diodes. Further, the solid state light emitting devices may emit radiation in the visible and/or near-infrared regions of the electromagnetic spectrum. The solid-state light emitting devices are selected because they emit radiation in the spectral regions in which charge coupled devices (CCDs) of the camera 220 are known to be photosensitive.

LEDs are also used as the light emitting devices because LEDs are more amenable to precise optical power regulation than halogen lamps. This is at least partially due to the smaller drive currents needed to operate the LEDs. In addition, the discrete nature of LEDs allows the wavelength of the emitted light to be more flexibly selected. Also, when driven electronically within the working parameters of the LEDs, the repeatability and reliability of the light output by the LEDs are both very high. In addition, some LEDs are capable of emitting light in the ultra-violet A frequency range, which improves the resolving power of imaging optics.

Still further, the light source 110 has one or more optical power monitoring devices incorporated within the light source 110. Preferably, these devices are silicon photodiodes whose spectral responsivity is matched to the spectral emission of the solid-state devices within light source 110. These optical power monitoring devices are not restricted by material or design. Any device capable of measuring the optical output of the solid-state devices within light source 110 can be used. Lastly, in the configuration where light source 110 can multiplex between illumination colors, each color has a dedicated device to monitor optical power incorporated within light source 110.

As shown in FIG. 1, the light source 110 emits the light beam 111 which is incident upon the beam deflector 130 of the light pattern controller 115. The beam deflector 130 is mounted on a shaft 121 of the motor 120. The beam deflector 130 tilts relative to the axis of the shaft 121 in proportion to the centrifugal force exerted on the beam deflector 130 when the motor shaft 121 rotates. The light beam 111 from the light source 110 is directed onto a mirror 134 (shown in FIG. 4) of the beam deflector 130, and is reflected from the mirror 134 by an angle which is defined by the tilt of the beam deflector 130.

Additionally, because the beam deflector 130 is rotating, the light beam 111 sweeps out a cone 113. The deflected light beam cone is incident upon the collimating element 140 and sweeps out a circular pattern on the surface of the collimating element 140. The collimating element 140 may be, for example, a condenser lens, a Fresnel lens, or a set of reflective louvers. The radius of the circular pattern is dependent upon both the distance of the collimating element 140 from the beam deflector 130 and also the angle at which the light beam 111 is deflected by the beam deflector 130. The greater the angle of deflection and the farther the collimating element 140 is from the beam deflector 130 the larger the circular pattern swept by the light beam 111 will be on the surface of the collimating element 140. Therefore, since the deflection angle is directly proportional to the rotational speed of the motor shaft 121 and since the size of the circular pattern is directly proportional to the deflection angle, the size of the circular pattern is directly proportional to the rotational speed of the motor shaft 121.

Also, the speed at which the light beam 111 traverses the circular pattern is directly proportional to the rotational speed of the motor shaft 121. Therefore, the rotational speed of the motor shaft 121 controls both the size of the circular pattern and the speed with which the light beam 111 traverses the circular pattern. Thus, the light pattern controller 115 controls the pattern swept by the light beam 111 on the collimator 140.

The light cone 113 is collimated by the collimator 140 to sweep out a cylinder. The light cylinder is reflected by the mirror 150 to be substantially parallel to and to surround an optical axis 212 of the imaging system 200. The imaging system 200 employs optical lenses 210 to image a field of view located at an object plane onto the image plane of the camera 220 (e.g., pixel array). The collimated pattern is focused onto the same field of view using the focusing element 160.

The motor 120 may be a direct current motor (DC), an alternating current motor (AC) or a stepper motor. Any other known or later developed motor can also be used as the motor 120 to provide accurate rotational position and speed control information. Preferably, the speed control of the rotary motor should be better than 1%.

The mirror 150 is angled relative to the optical axis 212 and has an aperture 151 positioned where the optical axis 212 passes through the plane of the mirror 150. The aperture 151 is sized to permit unobstructed transmission of an image of the sample part 300 to the camera 220.

The cylinder of light is then reflected by the mirror 150 toward the focusing element 160. The focusing element 160 can be a condenser lens, a Fresnel lens or the like. The focusing element 160 can also be a set of annular rings of mirrored louvers which are individually angled as a function of radius. The gradation in the angle of incidence of the light beam onto the sample part as a result of individual louvers or annular reflectors positioned at discrete radial locations in the focusing element 160 is discrete. It should be appreciated that any known or later developed element capable of collimating or focusing a light beam can also be used. It should also be appreciated that the collimator 140 may be identical to the focusing element 160.

The light beam 111 is then directed by the focusing element 160 onto the sample part 300 on the inspection plane 310. The focusing element 160 has a focal distance which coincides with an average working distance of the objective lenses 210. For example, if the objective lenses 210 image at magnification levels of 1×, 3×, 5×, and 10× and have corresponding effective working distances of 59.0 mm, 72.5 mm, 59.5 mm, and 44.0 mm, respectively, with a resulting average working distance of 58.75 mm, then selecting a nominal focal length of approximately 59.0 mm for the focusing element 160 will coincide with the average working distance of the objective lenses 210 to yield good performance within the operational magnification range.

Figure 2:
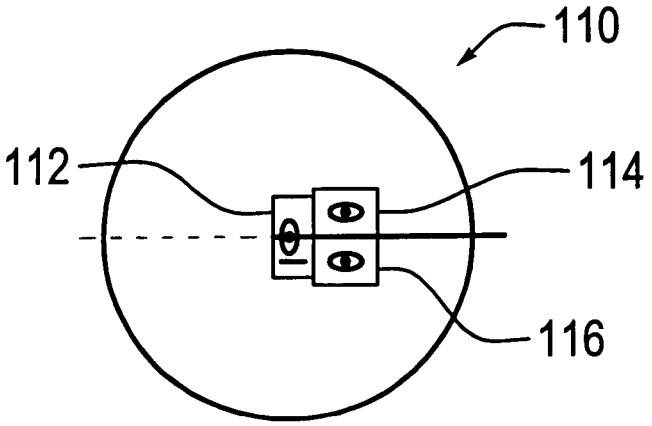
FIG. 2 is a plan view of an exemplary light source according to an embodiment of this invention.

As shown in FIG. 2, the light source 110 may include an array of solid-state devices 112, 114 and 116, which each have different characteristics. The LEDs 112–116 operate in the red, green and blue spectral regions, respectively. In another exemplary embodiment, the LEDs 112–116 can emit radiation in the near infrared or other spectral regions which are compatible with observation of the sample part 300. A light source 110 having multiple solid-state devices can multiplex among the individual solid-state devices to optimally illuminate the sample part. In addition, a multi-wavelength addressable light source can match or avoid the average spectral absorption properties of the sample part to enhance the image contrast.

Figure 3:
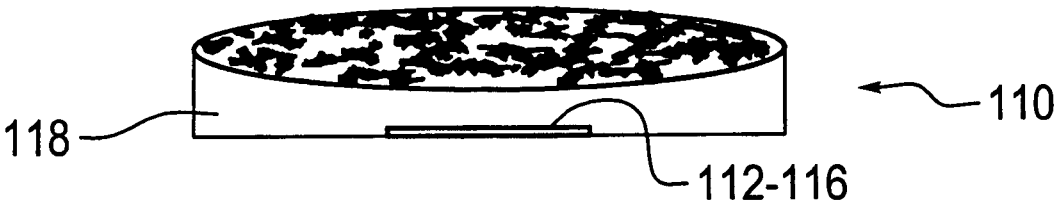
FIG. 3 is a sectional view of another exemplary light source according to an embodiment of this invention.

As shown in FIG. 3, the solid-state devices 112–116 may also be surface mounted in an acrylic-encapsulated package 118 to form the light source 110. For example, surface-mounted solid-state devices 112–116 can be combined with a collection and/or collimation lens to form the light source 110.

Figure 4:
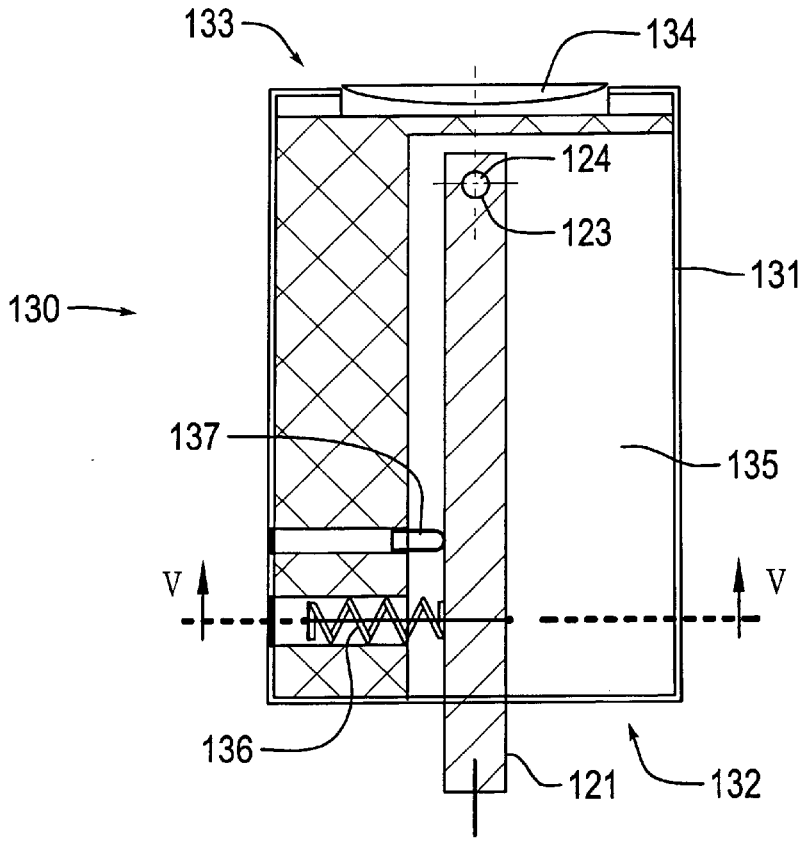
FIG. 4 is a sectional view of one embodiment of a beam deflector of a light pattern controller according to an embodiment of this invention.

FIG. 4 shows a sectional view of the beam deflector 130, which deflects the light beam 111 from the light source 110. The beam deflector 130 includes a cylindrically-shaped barrel 131 having a first end 132 and a second end 133. The second end 133 has a mirror 134. An internal cavity 135 of the beam deflector 130 defines an area in which the motor shaft 121 is received.

The motor shaft 121 is aligned with a transmitting axis 122. The motor shaft 121 also includes a hole 123 that accepts a clevis pin 124 about which the beam deflector 130 pivots.

As shown in FIG. 4, the center of mass of the beam deflector 130 is located to the left of the transmitting axis 122. Thus, when the motor shaft 121 rotates, a centrifugal force operates through the center of mass of the beam deflector 130 to push the center of mass away from the motor shaft 121.

A spring 136 within the beam deflector 130 counteracts the centrifugal force. Although the spring 136 is shown to provide a counteracting force, any known or subsequently developed device for applying a counteracting force can be used in accordance with this invention.

A position adjuster 137 is disposed, within the cavity 135 of the barrel 131. The position adjuster 137 adjusts an angle between the longitudinal axis of the barrel 131 and the transmitting axis 122 of the motor shaft 121 within a predetermined range. In one exemplary embodiment, the adjuster 137 adjusts the angle such that the angle is substantially equal to zero when the angular velocity of the shaft 121 is below a threshold velocity $\omega_0$.

The mirror 134 shown in FIG. 4 is a concave, spherical mirror having a center that is coincident with the transmitting axis 122. The mirror 134 may also be a planar or convex mirror. It should be understood that the mirror 134 may be any known or later developed reflector capable of reflecting electromagnetic radiation of the wavelengths emitted by the light emitting devices of the light source 110.

Figure 5:
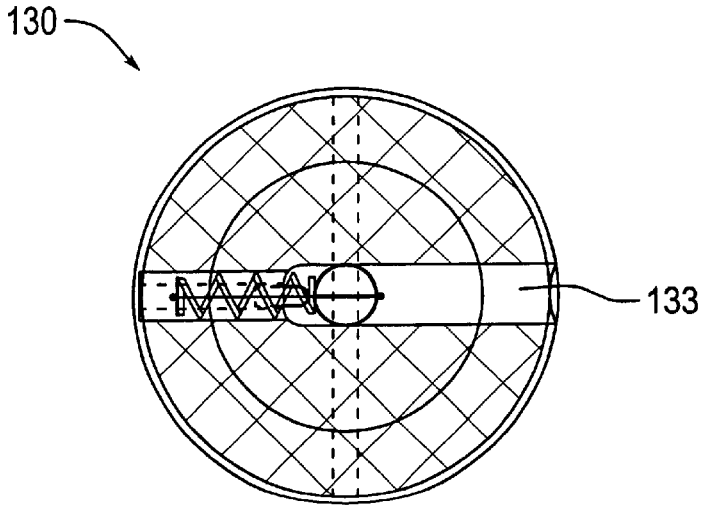
FIG. 5 is a sectional view of the beam deflector of FIG. 4 taken along line V—V.

FIG. 5 shows a sectional view of the beam deflector 130 taken through line V—V in FIG. 4. The cavity 135 forms a transverse slot to permit the barrel 131 to pivot inside about the clevis pin 124.

Accordingly, the beam deflector 130 generates two-dimensional circular patterns of light. The two-dimensional patterns of light have a variable radius that is a function of the angular velocity $\omega$ at which the beam deflector 130 rotates.

As discussed above, the mirror 134 reflects the light output by the light emitting devices of the light source 110. Furthermore, the focal length of the mirror 134 is chosen to provide a light beam having a predetermined diameter. The focal length of the mirror 134 is also chosen based on the performance of the light source 110. The diameter of the light beam 111 incident on the inspection plane 310 is chosen to provide adequate image brightness and field of view-conformity. For example, a mirror 134 having a diameter of approximately 12.5 mm can be used to provide a focal length of approximately 12 mm to 40 mm. The focal length of the mirror 134 is chosen to provide the clearest image of the sample part 300. The direction and/or divergence of the light beam 111 must be taken into consideration when choosing the mirror 134.

As discussed above, after the light beam 111 reflects off the mirror 150, the light beam 111 must be redirected onto the sample part 300. The focusing element 160 redirects the light beam 111 onto the sample part 300.

Figure 6:
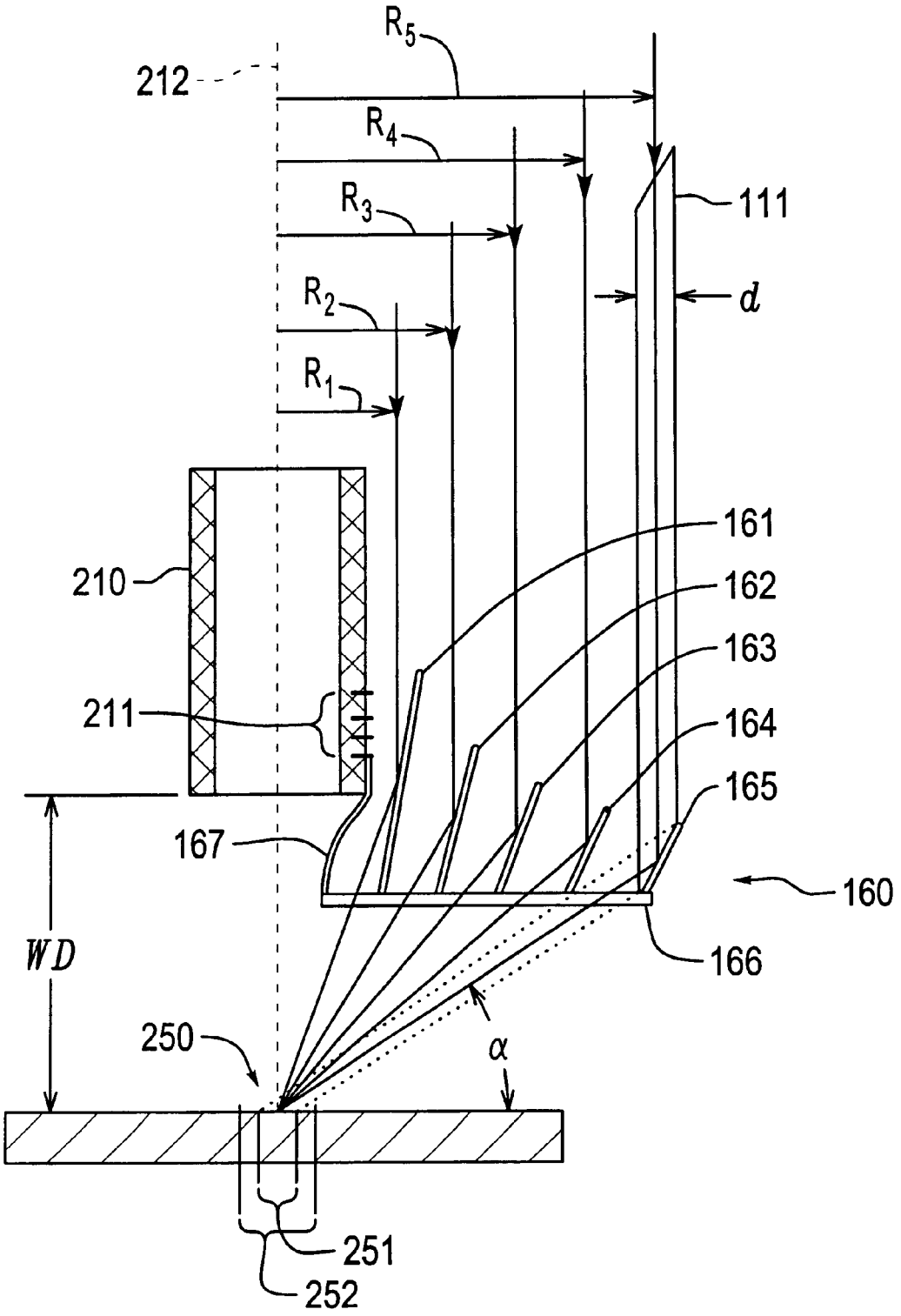
FIG. 6 is a partial sectional view of an exemplary focusing element according to this invention.

FIG. 6 shows a second exemplary embodiment of a focusing element 160 which has a plurality of mirrored surfaces 161–165. Each mirrored surface 161–165 reflects the light beam 111 that circumscribes a circle having a corresponding radius $R_1$–$R_5$. The larger the radius of the cylinder swept by the light beam 111, the larger the $R_1$–$R_5$ radii of the mirrored surfaces 161–165 that reflect the light beam 111. Each mirrored surface 161–165 reflects the light beam at a different angle of incidence a onto the sample part 300. The light beam 111 has a nominal diameter d. The inner flat surfaces of the mirrored surfaces 161–165 are first-surface mirrors optimized for spectral reflection in the visible and near-infrared portions of the electromagnetic spectrum.

In an exemplary embodiment of this invention, the mirrored surfaces 161–165 are injection-molded engineering plastic parts with a reflective coating deposited onto the inner flat surface. The ensemble of all mirrored surfaces 161–165 that make up the focusing element 160 are spatially rigid with respect to each other and the objective lens 210. The rigidity of the mirrored surfaces 161–165 is achieved using a transparent, donut-shaped base 166. Further, a bracket 167 fixes the assembly relative to the objective lens 210. Lastly, an angle of each mirrored surface 161–165 relative to the optical axis 212 is slightly different, to compensate for a change in the optical pathlength that results from the light beam 111 being refracted through the transparent material of the base 166.

It should be understood that it is possible to manually exchange the objective lens 210 with another objective lens of differing numerical aperture to increase or reduce the magnification. Typically, for machine vision instruments, the working distance WD of such lenses vary slightly (±25%) within the line of commonly-used microscope objective lenses. To this end, diffuse illumination with a variable angle of incidence a requires the illumination focal point of the mirrored surfaces 161–165 to be coincident with the focal point of the objective lens 210. One manual method of achieving this is to provide a unique detent positioner 211 near the focusing element 160 for each objective lens 210. This results in coincident foci at the focal point 250. The element 160 can then be correctly positioned when the objective lens 210 is exchanged.

Figure 7:
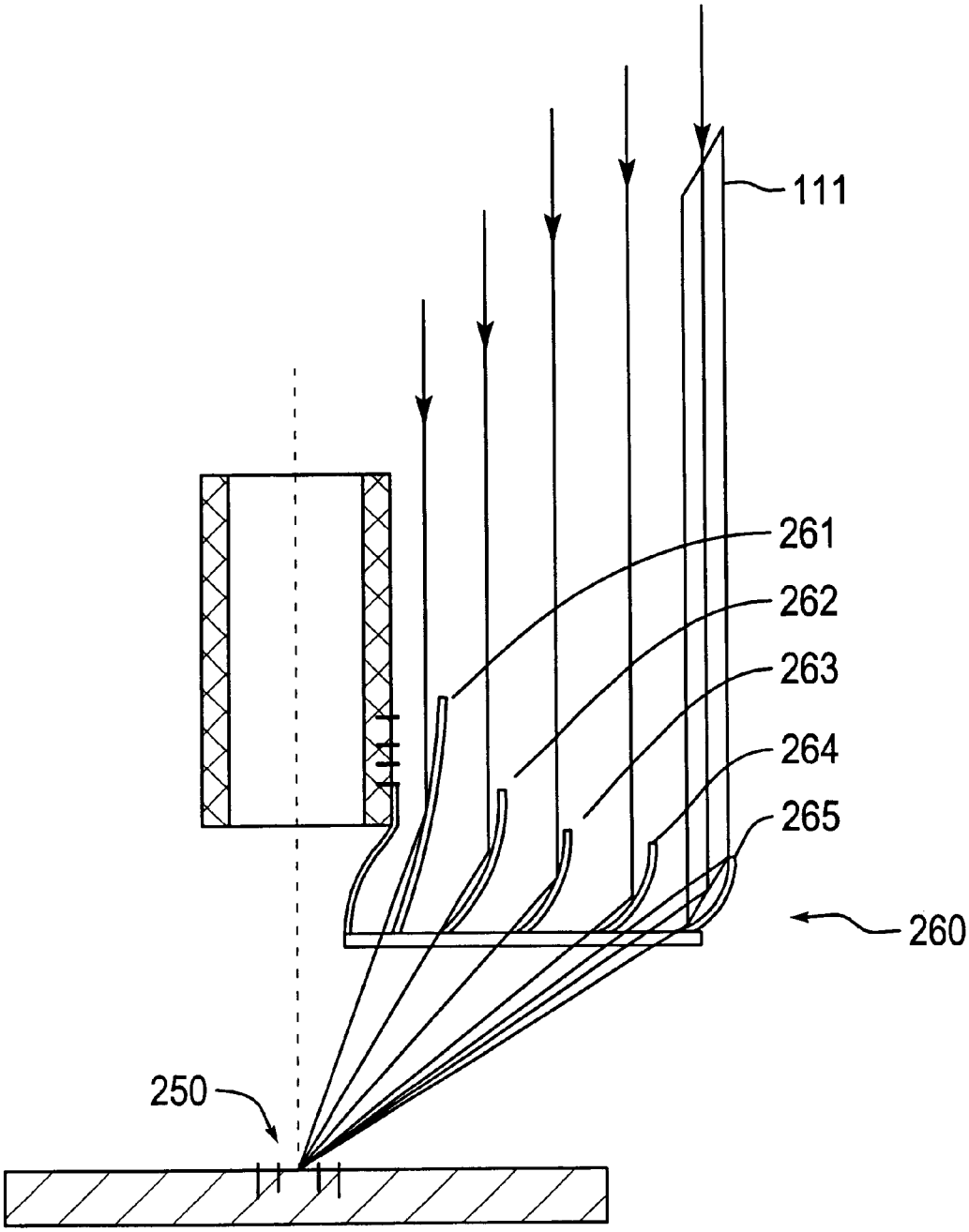
FIG. 7 is a partial sectional view of another exemplary focusing element according to this invention.

FIG. 7 shows a third exemplary embodiment of a focusing element 260 which has a plurality of annular, parabolic mirrored surfaces 261–265. Each mirrored surface 261–265 reflects the light beam 111, which sweeps a cylinder with corresponding radius, onto a focal point 250. As the radius of the cylinder varies throughout a corresponding range for a particular mirrored surface 261–265, the corresponding mirrored surface 261–265 reflects the light beam 111 onto the focal point 250 at a continuously varying angle of incidence.

The interior surfaces of focusing element 260 are first-surface mirrors created by deposition of an appropriately reflecting metal onto plastic. The parabolic shape enables the light beam 111 to be focused onto the focal point 250. This focusing increases the incident energy per unit area on the focal point 250.

Figure 8:
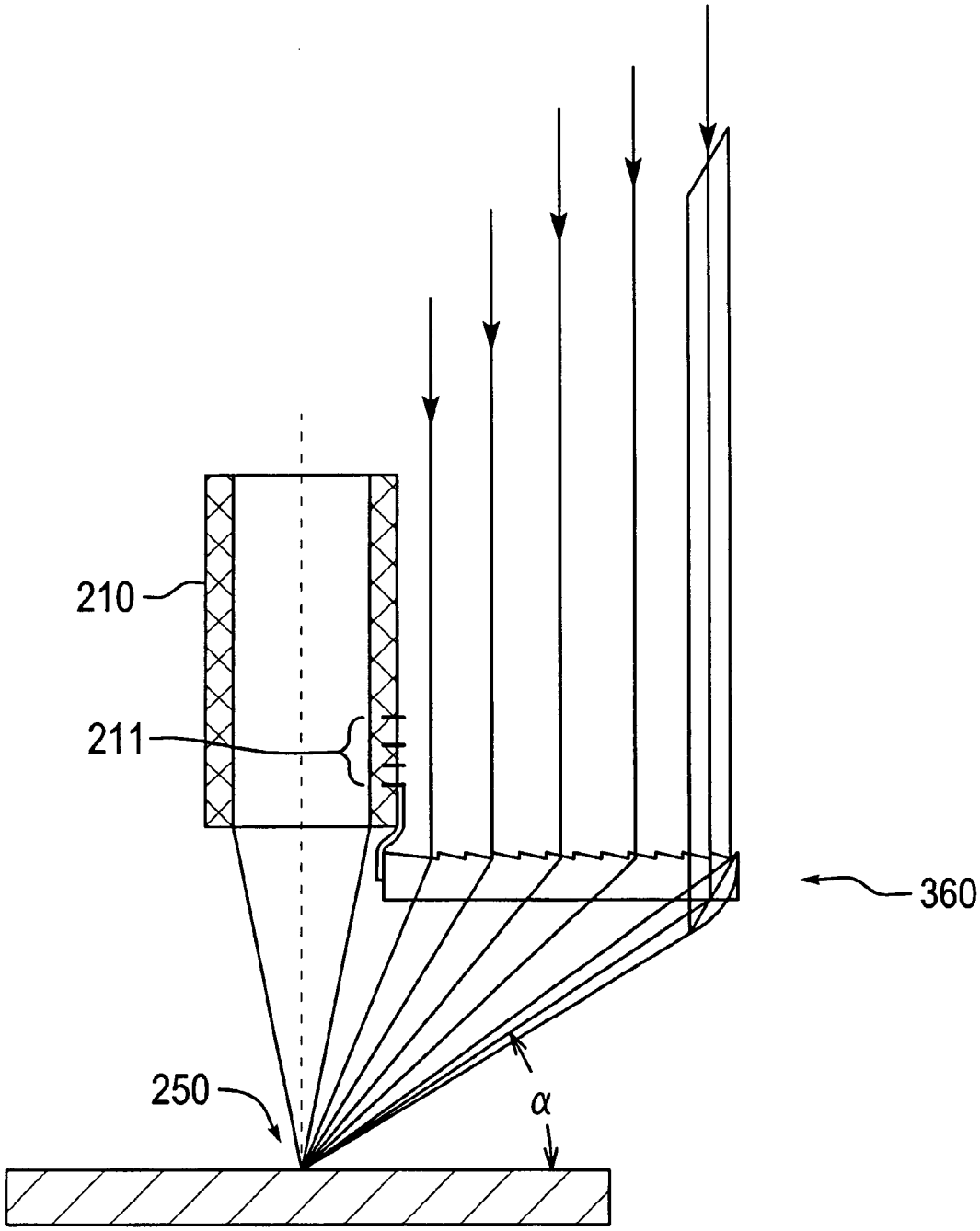
FIG. 8 is a partial sectional view of yet another exemplary focusing element according to this invention.

In the exemplary embodiment shown in FIG. 8, the focusing element 360 is a Fresnel lens. The Fresnel lens has focal length chosen such that it's focal point coincides with the focal point 250.

The sample part 300 is imaged by the camera 220 using the objective lenses 210. The optical axis 212 is perpendicular to the sample part 300 and is substantially perpendicular with the transmitting axis 122. After reflecting off of the mirror 150, light that was directed along the transmitting axis 122 is now substantially parallel to the optical axis 212. The optical axis 212 and the transmitting axis 122 intersect and have intersection substantially at the center of the aperature 151.

The focal point 250 has two symmetric areas of interest that surround the focal point 250. The first area corresponds to the field of view 251. Scattered and reflected light within the field of view 251 is imaged by the objective lens 210 onto the camera 220. Although a first linear dimension of the field of view area 251 is depicted, it should be understood that a second linear dimension is normal to the plane of the figure. The second area is larger than the first area and corresponds to an illumination field 252 which encompasses the field of view 251. Both the field of view 251 and the illumination field 252 also have a geometric center located at the focal point 250.

In the exemplary embodiment shown in FIG. 8, a variable angle of incidence a is created in like manner to the exemplary embodiment shown in FIGS. 6 and 7, except that the Fresnel lens is replaced with a suitable spherical or aspherical lens. Again, the spherical or aspherical lens has focal length chosen such that it's focal point coincides with the focal point 250. Also, differing working distances can be accommodated manually by providing a different detent positioner 211 for the lens 210 that will result in coincident foci at point 250.

Figure 9:
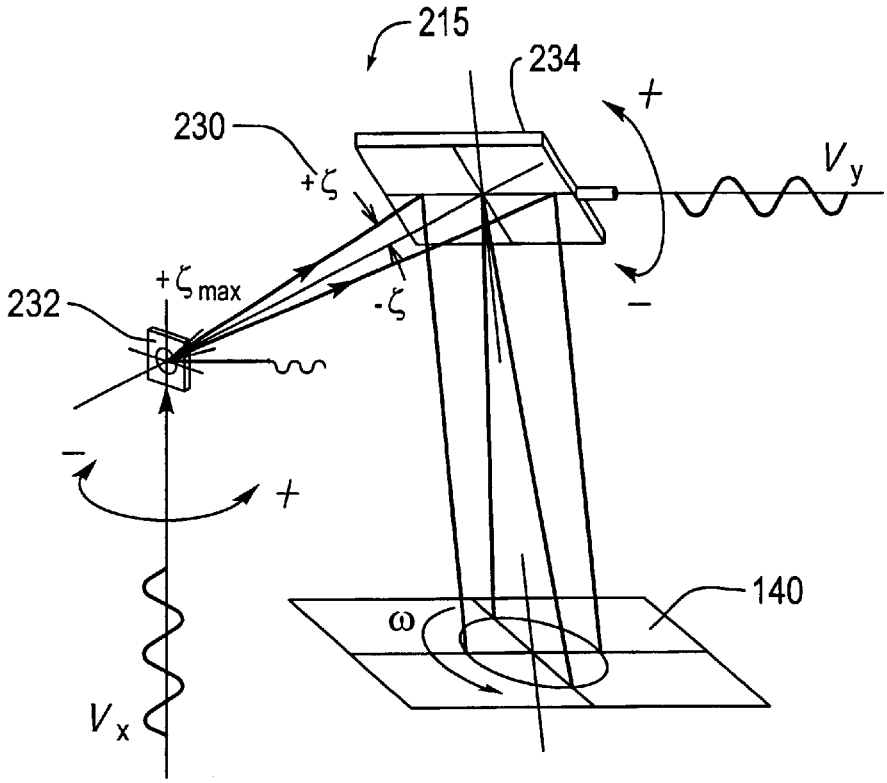
FIG. 9 shows another exemplary embodiment of a light pattern controller in accordance with this invention.

FIG. 9 shows a second exemplary embodiment of a light pattern controller 215 which includes a beam deflector 230 in accordance with this invention. The beam deflector 230 is a two-dimensional scanning galvanometer. To achieve illumination symmetry about the optical axis 212, the swept pattern is made circular. Further, this circular pattern is created using two angular scanning galvanometers whose scan axes are orthogonal to each other. A circular pattern is created by the input drive signals ($V_x$ and $V_y$) to each scanning galvanometer. The two scanning input waveforms are sinusoids described by:

$$V_x = A_x \sin(2\pi f_x t + \theta_x); \text{ and} \quad (1)$$

$$V_y = A_y \sin(2\pi f_y t + \theta_y). \quad (2)$$

where:

$\theta_x$=phase angle of sinusoid $V_x$ with respect to a reference sine wave ($V_x$ is designed to follow the reference sine wave faithfully with zero phase difference);

$\theta_y$=phase angle of sinusoid $V_y$ with respect to $V_x$;

$f_x$=angular scanning frequency of galvanometer X; and $f_y$=angular scanning frequency of galvanometer Y. Additionally, to obtain a symmetric, circular pattern, the input waveforms must be controlled such that:

$$(\theta_x-\theta_y)=\pi/2,\ 3\pi/2 \tag{3}$$

Also, the drive frequencies $f_x$ and $f_y$ are controlled to provide the proper number of circular sweep cycles per video field integration in the CCD of the camera 200. A minimum execution of two whole sweep cycles per field integration will minimally assure meeting the Nyquist criteria of the camera 220. Further, all sweep cycles per field integration should be whole numbers to ensure that interlaced fields produce spatially similar illumination patterns in assembled frames. The drive frequencies are controlled according to:

$$f_x=f_y \tag{4}$$

where:

$$f_{min}\leqq f_i\leqq f_{resonant} \tag{5}$$

In the case of an RS 170 camera with interlaced fields, $f_{min}$ is twice as fast as the overlap time period between odd and even fields. This overlap period is 16⅔ msec. Therefore, $f_{min}$ would correspond to a sweep rate occurring at least 2 times within this period or every 8⅓ msec (120 Hz). Choice of the XY scanner and the inertia of each mirror restrict the upper limit, $f_{resonant}$. Input of equivalent drive frequencies meets the final requirement for a symmetric, circular sweep pattern.

The amplitude of each waveform is also controlled based on the angle of incidence a which is desired by the user. Essentially, the waveform amplitudes are chosen such that:

$$A_x=A_y \tag{6}$$

where:

$A_i$ represents the peak amplitude (or sweep circle radius) for each specific desired angle of illumination incidence $\alpha$. This radius or amplitude is selectable within the mirror scan angle range $\zeta_i$, where $-\zeta_{max}\leqq\zeta_i\leqq+\zeta_{max}$.

As a result, the diameter of the circularly scanned pattern is controlled by the choice of waveform amplitudes.

In an exemplary embodiment of the invention, a lookup table which translates between the angle of incidence and the input voltage values to the scanning galvanometer is used. As discussed with the above parameters, illumination conditions selected by the user dictate the specific input settings to each scanner axis.

Figure 10:
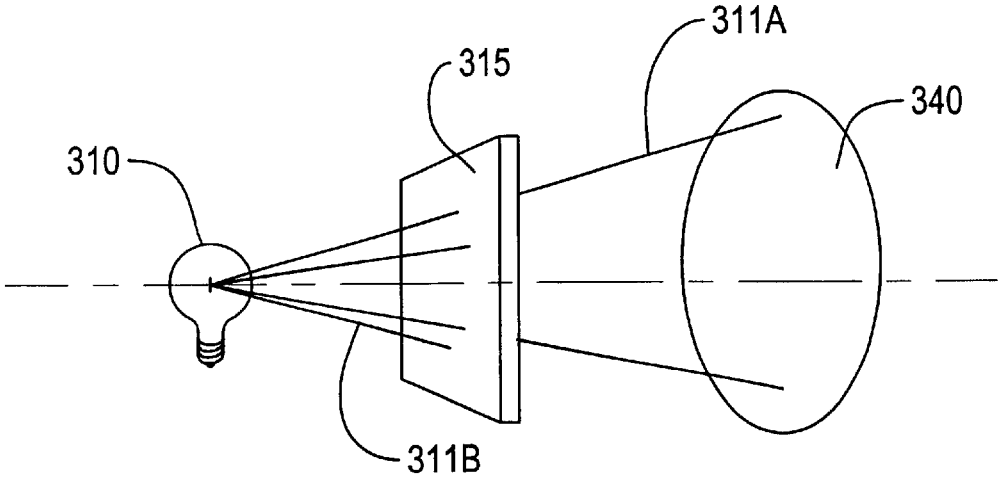
FIG. 10 shows yet another embodiment of a light pattern controller in accordance with this invention.

FIG. 10 shows another exemplary embodiment of a light pattern controller 315. A light source 310 emits a diverging light stream which impinges upon the light pattern controller 315. The light pattern controller 315 is a liquid crystal device. The liquid crystal device includes an array of addressable sectors which are controllable to block portions of the light from the light source 310 from impinging upon the collimator 340. For example, a light ray 31 IA impinges upon the light pattern controller 315 and passes through to impinge and be collimated by the collimating element 340. By contrast, a light ray 311B impinges upon the light pattern controller 315 but is blocked to prevent the light ray 311B from passing through and impinging upon the collimator 340. Therefore, the liquid crystal shutter of the light pattern controller 315 controls the pattern of light from the light source 310 that impinges upon the collimator 340.

It should be appreciated that the addressable sectors can be in any desired shape, such as a square pixel-like shape or a arcuate sector-like shape.

It should be understood that the liquid crystal device may also include an array of addressable pixels and may also operate in a reflective mode rather than the blocking mode described above.

It is to be understood that while the detailed description described light deflectors for projecting a prescribed pattern onto a collimating element in a serial manner that generation of a prescribed pattern may also be accomplished in a parallel manner. Two means to realize parallel pattern generation is with the use of addressable liquid crystal displays (LCDs) and addressable holographic light splitting elements. Any known or later developed structure for and/or method of directing a prescribed pattern onto a surface of a collimating element may be used.

It is also to be understood that while the detailed description described a beam deflector and a two-dimensional scanning galvanometer for projecting a prescribed pattern onto a collimating element that any known or later developed structure for and/or method of sweeping a pattern onto a surface of a collimating element may be used.

While the description set forth above refers generally to light being emitted from a light source having a solid state device, it should be understood that the invention may also utilize more conventional light sources such as a filament-type. Additionally, it should be understood that the light source of the invention may also emit radiation outside of the visible spectrum in useful regions capable of being sensed. Specifically, these spectral regions include the ultraviolet A and near infrared portions of the spectrum.

While this invention has been described in conjunction with the specific embodiments outlined above, it is evident that many alternatives, modifications and variations are apparent to those skilled in the art. Accordingly, the embodiments of the invention as set forth above are intended to be illustrative and not limiting. Various changes may be made without departing from the spirit and scope of the invention.

What is claimed is:

1. An apparatus for diffuse illumination, the apparatus comprising:

a light source;

a light pattern controller that receives light from the light source and creates a prescribed pattern of light;

a collimator that receives and collimates the prescribed pattern of light; and a focusing element that focuses the collimated light pattern of light.

2. The apparatus of claim 1, wherein the focusing element redirects portions of the collimated pattern of light at an angle which is a function of the radial location of the portion from an optical axis of the focusing element.

3. The apparatus of claim 1, further comprising a reflector that reflects the collimated pattern of light from the collimator onto the focusing element.

4. The apparatus of claim 1, wherein the light pattern controller creates the prescribed pattern by blocking part of the light emitted by the light source.

5. The apparatus of claim 4, wherein the light pattern controller comprises at least one segment of a liquid crystal device.

6. The apparatus of claim 1, wherein the light pattern controller creates the prescribed pattern of light by diffracting at least part of the light emitted by the light source.

7. The apparatus of claim 1, wherein the light pattern control element comprises a movable deflector which deflects a beam of light from the light source to create the prescribed pattern of light over a period of time.

8. The apparatus of claim 7, wherein the deflector deflects the light beam in a circular pattern.

9. The apparatus of claim 7, wherein the deflector comprises a reflector.

10. The apparatus of claim 7, wherein the deflector comprises a refractive element.

11. The apparatus of claim 7, wherein the deflector comprises a two-dimensional scanning galvanometer.

12. The apparatus of claim 7, wherein the deflector comprises:

a motor having a rotatable shaft; and a mirror mounted on the rotatable shaft, the mirror adapted to tilt in response to rotation of the rotatable shaft.

13. The apparatus of claim 12, wherein the deflector further comprises:

a barrel having a first end, a second end and an internal cavity, wherein the mirror is attached to the second end and the rotatable shaft is received through the first end into the internal cavity, the rotatable shaft connected to the barrel along a hinge axis, and the barrel having a center of mass offset from the axis of the rotatable shaft; and a spring that provides a force opposing a centrifugal force acting through the center of mass, the centrifugal force generated in response to a rotation of the rotatable shaft and the barrel.

14. The apparatus of claim 13, further comprising a position adjuster that sets a position of the barrel when not rotating.

15. The apparatus of claim 1, wherein the collimating element is a spherical lens.

16. The apparatus of claim 1, wherein the collimating element is an aspherical lens.

17. The apparatus of claim 1, wherein the collimating element comprises a plurality of annular mirrored surfaces.

18. The apparatus of claim 17, wherein each of the plurality of annular mirrored surfaces is parabolic.

19. The apparatus of claim 1, wherein the collimating element comprises a Fresnel lens.

20. The apparatus of claim 1, wherein the focusing element is a spherical lens.

21. The apparatus of claim 1, wherein the focusing element is an aspherical lens.

22. The apparatus of claim 1, wherein the focusing element comprises a plurality of annular mirrored surfaces.

23. The apparatus of claim 22, wherein each of the plurality of annular mirrored surfaces is parabolic.

24. The apparatus of claim 1, wherein the focusing element comprises a Fresnel lens.

25. The apparatus of claim 1, wherein the light source comprises at least one solid state device.

26. The apparatus of claim 25, wherein each of the at least one solid state device is a light emitting diode.

27. The apparatus of claim 26, wherein at least two of the at least one light emitting diode emits light in a different frequency range.

28. A machine vision system, comprising:

a light source;

a light pattern controller that receives light from the light source and creates a prescribed pattern of light;

a collimator that receives and collimates the prescribed pattern of light;

a focusing element that focuses the pattern onto an object; and a camera that outputs an image of the object.

29. The system of claim 28, wherein the camera comprises one of a monochrome CCD array and a color CCD array.

30. A method for providing diffuse illumination at a prescribed angle of incidence, comprising:

generating a prescribed pattern of light;

collimating the prescribed pattern of light; and focusing the collimated prescribed pattern of light.

31. The method of claim 30, wherein generating the prescribed pattern of light comprises deflecting a light beam to sweep out a circular pattern.

32. The method of claim 31, wherein deflecting the light beam comprises rotating a mirror on a rotating motor shaft.

33. The method of claim 32, further comprising changing the radius of the circular pattern by changing the speed of the rotating motor shaft.

34. The method of claim 30, further comprising reflecting the collimated pattern of light before focusing the collimated pattern of light.

35. The method of claim 30, further comprising focusing portions of the collimated pattern of light at an angle which is a function of the radial location of each respective portion from an optical axis.

36. The method of claim 30, further comprising changing the prescribed pattern of light to change the prescribed angle of illumination.

37. The method of claim 30, wherein the step of generating the prescribed pattern of light comprises generating light and selectively blocking portions of the light from being collimated.

38. The method of claim 30, wherein the step of generating the prescribed pattern of light comprises generating light and selectively diffracting portions of the light.

39. The apparatus of claim 1, wherein the focusing element focuses the collimated light pattern of light onto an object, further comprising a camera that outputs an image of the illuminated object.

40. The machine vision system of claim 28, wherein the light pattern controller is a deflector that deflects the light beam from the light source in the prescribed pattern onto the collimator.

41. An apparatus for diffusely illuminating an object, the apparatus comprising:

a light source;

a light pattern controller that receives light from the light source and creates a prescribed pattern of light;

a collimator that receives and collimates the prescribed pattern of light;

a focusing element that focuses the collimated light pattern of light onto the object; and a camera that outputs an image of the object.

42. The system of claim 41, wherein the camera comprises one of a monochrome CCD array and a color CCD array.

43. An apparatus for diffuse illumination, the apparatus comprising:

a light source;

a light pattern controller that receives light from the light source and creates a prescribed pattern of light, comprising a movable deflector which deflects a beam of light from the light source to create the prescribed pattern of light over a period of time; and a focusing element that focuses the prescribed pattern of light.

44. The apparatus of claim 43, further comprising a collimator that receives and collimates the prescribed pattern of light, wherein the focusing element focuses the collimated pattern of light.

45. An apparatus for diffuse illumination, the apparatus comprising:

a light source;

a light pattern controller that receives light from the light source and creates a prescribed pattern of light;

a collimator that receives and collimates the prescribed pattern of light, the collimated prescribed pattern of light transmitted along a zone generally surrounding an optical path of an imaging system; and a focusing element that focuses the collimated pattern of light.

46. The apparatus of claim 45, wherein the focusing element focuses the collimated pattern of light proximate to a focal point of the imaging system.

47. A machine vision system having an optical axis and comprising the apparatus of claim 1, wherein the collimated pattern of light circumscribes the optical axis of the machine vision system.

48. The machine vision system of claim 28, wherein:

the camera receives an image of the object, the image transmitted along an optical axis; and the collimated pattern of light circumscribes the optical axis.

49. The method of claim 30, further comprising projecting the collimated pattern of light proximate to an optical axis of a vision device, wherein the collimated pattern of light circumscribes the optical axis.

50. The system of claim 41, wherein:

the camera receives an image of the object, the image transmitted along an optical axis; and the collimated pattern of light circumscribes the optical axis.

51. A machine vision system having an optical axis and comprising the apparatus of claim 44, wherein the collimated pattern of light circumscribes the optical axis of the machine vision system.

52. A machine vision system having an optical axis and comprising the apparatus of claim 45, wherein the collimated pattern of light circumscribes the optical axis of the machine vision system.

* * * * *